US008571225B2

(12) United States Patent
Botti et al.

(10) Patent No.: US 8,571,225 B2
(45) Date of Patent: Oct. 29, 2013

(54) METHOD AND CIRCUIT FOR TESTING AN AUDIO HIGH-FREQUENCY LOUDSPEAKER BEING PART OF A LOUDSPEAKER SYSTEM

(75) Inventors: Edoardo Botti, Vigevano (IT); Giovanni Gonano, Padua (IT); Pietro Mario Adduci, Settimo Milanese (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 1400 days.

(21) Appl. No.: 12/249,708

(22) Filed: Oct. 10, 2008

(65) Prior Publication Data

US 2009/0097667 A1 Apr. 16, 2009

(30) Foreign Application Priority Data

Oct. 12, 2007 (EP) ..... 07425643

(51) Int. Cl.
*H04R 29/00* (2006.01)

(52) U.S. Cl.
USPC ..... 381/59; 381/96

(58) Field of Classification Search
USPC ..... 381/59, 58, 98, 99, 96; 324/522, 523, 324/524, 539, 540, 541, 542, 543
See application file for complete search history.

(56) References Cited

U.S. PATENT DOCUMENTS

| | | | | |
|---|---|---|---|---|
| 2005/0163326 | A1 * | 7/2005 | Heuer | 381/59 |
| 2006/0126857 | A1 | 6/2006 | Pavlov et al. | |
| 2007/0057720 | A1 * | 3/2007 | Hand et al. | 330/10 |
| 2007/0153780 | A1 | 7/2007 | Stanley | |

FOREIGN PATENT DOCUMENTS

JP 57 065100 A 4/1982

OTHER PUBLICATIONS

Colloms, M. (2000). "High Performance Loudspeakers" (5th Ed., pp. 423-425, Fig. 9.41) John Wiley & Sons.

* cited by examiner

*Primary Examiner* — Benjamin Sandvik
*Assistant Examiner* — Leslie Pilar Cruz
(74) *Attorney, Agent, or Firm* — Seed IP Law Group PLLC

(57) ABSTRACT

The present invention relates to a method and a circuit for testing a tweeter, said tweeter being part of a loudspeaker system, wherein the method includes the steps of: applying a high-frequency voltage signal to one terminal of said tweeter, said high-frequency voltage signal being generated by first electronic means; applying a constant voltage signal to the other terminal of said tweeter, said constant voltage signal being generated by second electronic means; measuring a current $I_{load}$ that flows through said tweeter into said second electronic means; determining a connect/disconnect state of said tweeter from the value of said current.

19 Claims, 10 Drawing Sheets

METHOD AND CIRCUIT FOR TESTING AN AUDIO HIGH-FREQUENCY LOUDSPEAKER BEING PART OF A LOUDSPEAKER SYSTEM

PRIORITY CLAIM

This application claims the benefit under 35 U.S.C. §119 (a) of European Patent Application No. 07425643.9, filed Oct. 12, 2007, which is incorporated herein by reference in its entirety.

BACKGROUND

1. Technical Field

The present invention relates to a method and a circuit for testing a high-frequency sound reproducing loudspeaker being part of a loudspeaker system.

2. Description of the Related Art

The output stages of loudspeaker systems, which are installed for instance on board motor vehicles, usually feature either a low frequency sound reproducing loudspeaker and a medium-frequency sound reproducing loudspeaker or a single medium-low sound frequency reproducing loudspeaker, which are generally directly connected to the amplifiers of such output stages.

An additional loudspeaker is usually provided, for reproducing high audio frequencies (also referred to hereinafter as "tweeter"), which is connected to the amplifiers of such output stages via a capacitor, as well as to the other loudspeakers.

Particularly, the operation of such loudspeaker systems is checked when they are installed in the vehicle.

Prior art diagnostic methods and circuits are known to be able to only ascertain the connect/disconnect state of the low and/or mid-frequency sound reproducing loudspeaker, because such loudspeaker is directly connected to the outputs of the output stage amplifiers.

A tweeter connected to the output stages via a capacitor cannot be tested using the methods and circuits developed for low and/or mid-frequency sound loudspeakers.

In view of obviating such drawbacks, it is known to use a circuit that implements a test during which an AC signal (typically an ultrasonic sine wave, e.g. at a frequency above 20 KHz) is transmitted to the tweeter and the current flowing in the tweeter is checked for its amplitude, to determine whether the tweeter is connected.

In recent times, Class D switching amplifiers are being increasingly used, also in the automotive field, and provide a much greater efficiency than Class AB amplifiers.

With reference to FIG. 1, there is shown a possible configuration of a bridge-type Class D switching amplifier 1 installed in a motor vehicle, which can drive a loudspeaker system 1A.

The bridge-type switching amplifier 1 is schematically composed of a left arm 2 and a right arm 3, each being coupled to a terminal of the loudspeaker system 1A via pass-band filters 5 and 6.

The left arm 2 has a first input 2A, a second input 2A' and an output 2C, the latter being in feedback relationship with the second input via a feedback line 2B, and the right arm 3 also has a first input 3A, a second input 3A' and an output 3C, the latter being in feedback relationship with said second input 3A' via a feedback line 3B.

As shown in FIG. 1, each of the left arm 2 and the right arm 3 has a feedback arrangement thanks to a feedback line 2B and 3B at a point 2C and 3C of the circuit 1, upstream from the low-pass filter 5, 6.

The loudspeaker system 1A is embodied by a load 4, as shown in FIG. 2, which can consist, for example, of a combination of a low frequency loudspeaker 4A (woofer) and a high-frequency loudspeaker 4B (tweeter).

As is shown, the tweeter 4B is coupled to the woofer 4A via a filter 4C which can filter the high frequencies of the signal delivered by the amplifier 1.

Each of the low-pass filters 5 and 6 includes an inductor L1, L2 in series with a capacitor C1, C2.

Particularly, the inductor L1 is connected on one side to the output 2C of the left arm 2 of the amplifier, which output also acts as a virtual ground, and on the other side to the capacitor C1 and to a terminal 4D of the load 4; the capacitor C1 in turn having a terminal connected to the ground.

The same applies to the low-pass filter 6, in which the inductor L2 is connected on one side to the output 3C of the right arm 3 of the amplifier, which output also acts as a virtual ground, and on the other side to the capacitor C2 and to a terminal 4E of the load 4; the capacitor C2 in turn having a terminal connected to the ground.

During operation of the amplifier 1, the voltage at the output terminals 2C and 3C is a modulated square wave which is low-pass filtered by the filters 5 and 6 before being transmitted to the load 4, so that the audio component to be reproduced by the load can be extracted from the square wave signal.

If low-pass filtering were not provided, there might be electromagnetic compatibility problems (electromagnetic interference, EMI) and an unnecessary high power would be dissipated, thereby causing damages to the load.

In order to determine whether the tweeter 4D is actually connected to the terminals 4D and 4E, also with reference to FIG. 1, an electronic current-reading device 7 is provided, allowing measurement of the amplitude of the current $I_{load}$ circulating in the tweeter 4B.

In this configuration, the test for determining whether the tweeter 4D of the loudspeaker system 1A is actually connected to the terminals 4D and 4E, according to a specific method, is performed by applying a test voltage VinAC varying in frequency, e.g. at a frequency above 20 KHz, to each input terminal 2A and 3A of the arms 2 and 3 of the amplifier.

Particularly, a voltage +VinAC may be applied to the input 2A, which voltage is replicated (at least ideally) by the feedback 2B, to the terminal 4D of the load 4, and a voltage −VinAC may be applied to the input 3A, i.e. a voltage opposite in phase to the voltage applied to the input 2A, which is replicated (at least ideally) by the feedback 3B to the terminal 4E of the load 4.

Nevertheless, the presence of the low-pass filters 5 and 6 causes problems in reading the proper current in the load 4: the low-pass filters 5 and 6 at the frequencies of the variable test signal ±VinAC, of about 20 KHz, do not correspond to an infinite load, but a current $I_{outamp}$ flows in such load 4, and adds to the load current $I_{load}$.

Thus, the current detection device 7 detects both the $I_{load}$ current flowing into the load 4 and the current circulating in the capacitor C2 (or the capacitor C1 if the detection device 7 is coupled to the left arm 2 of the amplifier 1).

This may affect accuracy or make the method as described above for detecting the load 4 totally ineffective.

Also, with further reference to FIGS. 3 and 4, there are shown the results of two simulations of the circuit as shown in FIG. 1, in which the x axis indicates time in msec, and the y axis indicates current in amperes, when the load 4 is simulated as an impedance having a resistance value of 4Ω (see FIG. 4).

In both simulations, L1 and L2 are assumed to be 20 μH and C1, C2 are assumed to be 2 μF and Vout=4Vpeak (i.e. the potential difference between the points 4D and 4E when a sinusoidal peak voltage of +2V/−2V is applied to the input terminals 2A and 3A respectively).

Particularly, it can be noted that both the load current $I_{load}$ and the current $I_{outamp}$ flowing through the low-pass filter 6 into the left arm 3 flow into the load 4, because the frequencies at which the variable test signal −Vin is applied do not correspond to an infinite load.

It should be noted that, for clarity, the simulations of FIGS. 3 and 4 do not account for the current associated with the output square wave, typically of a relatively low value, and reduced to a negligible value by other techniques, which are well known to those of ordinary skill in the art and will not be described herein.

Still with reference to such FIGS. 3 and 4, the results of such simulations show that the current $I_{load}$ that flows into the load 4 and the current $I_{outamp}$ that flows in the right arm 3 can assume the following values:

- if the load 4 is simulated by a 10 KΩ resistance (see FIG. 3), corresponding to a situation in which such load 4 is an open circuit, the current $I_{outamp}$ is in a range of peak values from −2A to +2A, whereas the current $I_{load}$ that flows into the load is substantially zero;
- if the load 4 is simulated by a 4Ω resistance (see FIG. 4), corresponding to a situation in which such load 4 is a normal load (i.e. a normal loudspeaker combination), the current $I_{outamp}$ is in a range of peak current values from about −1A to +1A, whereas the current $I_{load}$ that flows into the load 4 is also in a range of peak current values from about −1A to +1A.

Apparently, no accurate detection is possible if the load 4 is simulated by a 10 KΩ resistance (see FIG. 3) because, while the load current $I_{load}$ has a negligible or zero value, the current $I_{outamp}$ is very high, of about 2A, due to the current that flows in the output filter 5.

In other words, the device 7 reads a current value that cannot be used to determine whether the load 4 is actually disconnected.

BRIEF SUMMARY

Therefore, a need is strongly felt of checking the connect/disconnect state of a tweeter, to facilitate maintenance and/or testing.

In other words, a need is felt of checking for a disconnected terminal of a loudspeaker connected to the outputs via a capacitor.

One embodiment obviates the above mentioned problems of prior art testing methods and circuits.

One embodiment is a method for testing a tweeter being part of a loudspeaker system as defined by the features of claim 1.

One embodiment is a circuit for testing a tweeter being part of a loudspeaker system as defined by the features of claim 7.

Thanks to the present invention, a testing method and a testing circuit can be provided for more accurately determining whether a tweeter being part of a loudspeaker system is connected to the output stage of an amplifier.

BRIEF DESCRIPTION OF THE SEVERAL VIEWS OF THE DRAWINGS

The features and advantages of the invention will appear from the following detailed description of one practical embodiment, which is illustrated without limitation in the annexed drawings, in which.

DETAILED DESCRIPTION

Figure 1:
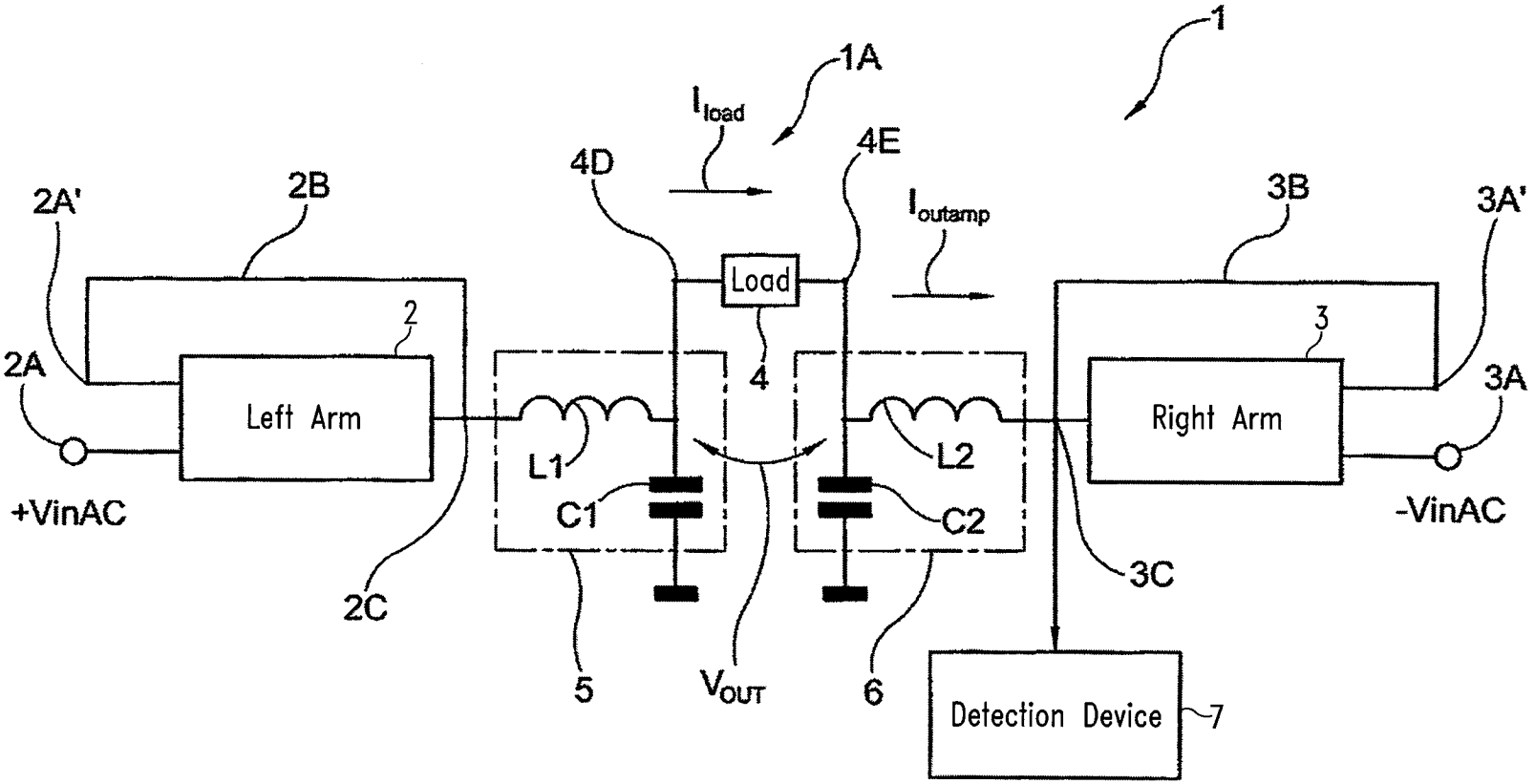
FIG. 1 (Prior Art)
FIG. 1 shows a possible circuit configuration of an output stage with a Class D switching amplifier when a load is connected to the terminals, according to the prior art.
Figure 2:
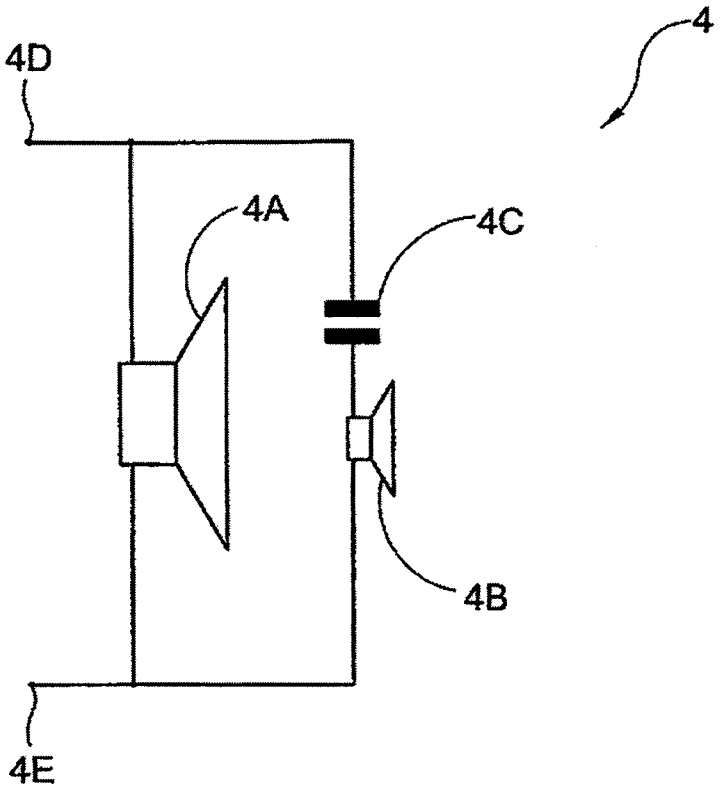
FIG. 2 (Prior Art)
FIG. 2 shows a schematic view of the load of FIG. 1, i.e. a possible circuit implementation of a loudspeaker system, according to the prior art.

Referring now to FIGS. 5 to 10, in which the elements described above are designated by identical reference numerals, the circuit for testing a tweeter 4*b* being part of the load 4 is shown to comprise:

- a first electronic circuit 8 for generating a voltage signal VinAC to be applied to a first terminal, such as the terminal 4D, of the load 4;
- a second electronic circuit 9 for generating a constant voltage signal VinDC to be applied to a second terminal, such as the terminal 4E, of the load 4;
- the current detection device 7 connected to the left arm 2 of said amplifier 1, depending on where said second electronic means 9 are connected.

Figure 5:
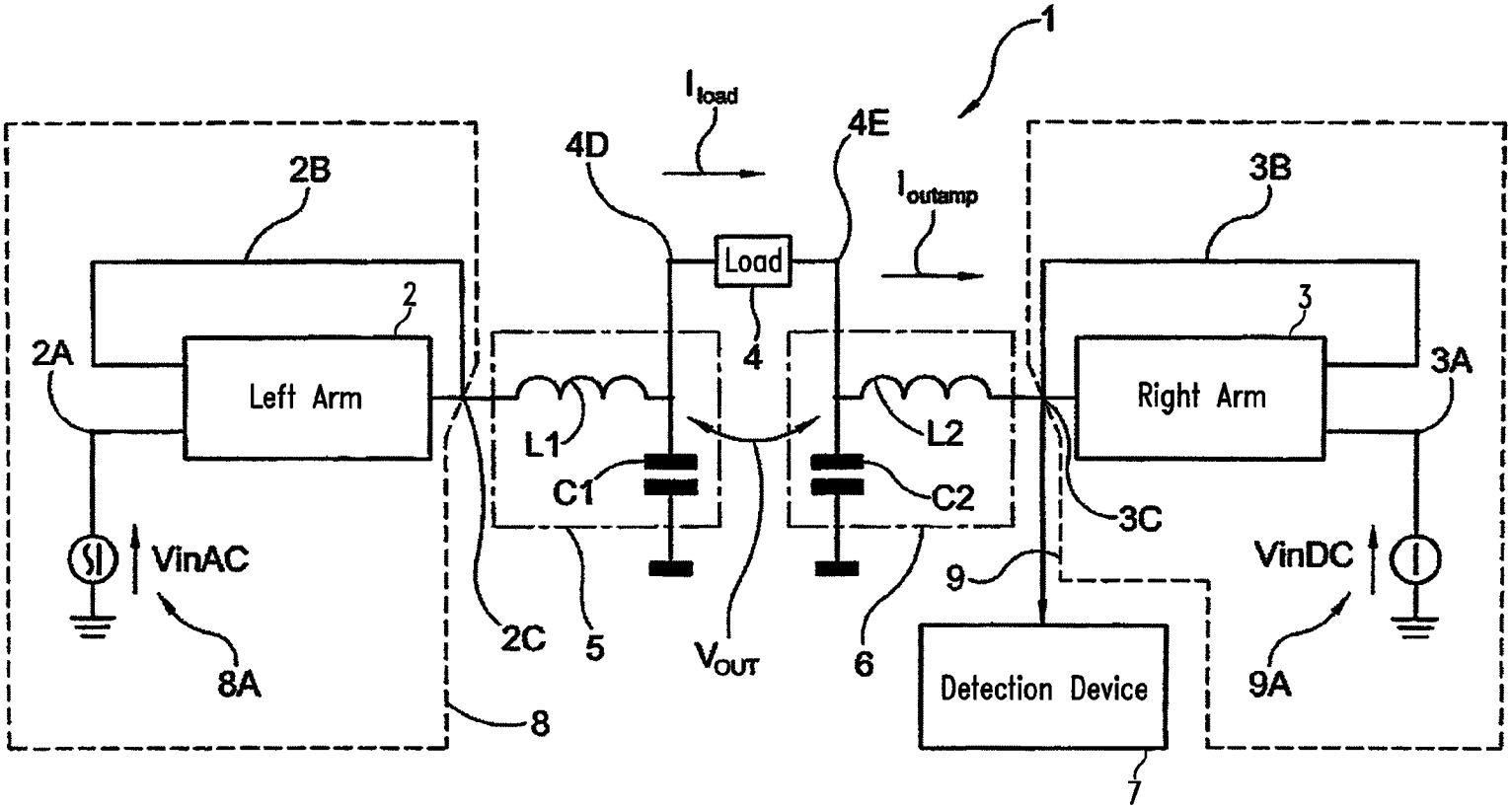
FIG. 5 shows a possible circuit implementation of the present invention.

Particularly, as namely shown in FIG. 5:

- the first electronic circuit 8 for generating a voltage signal VinAC includes a voltage generator 8A that can preferably generate a sinusoidal voltage signal having a frequency above 20 KHz, which is coupled to the input terminal 2A of the left arm 2,
- the second electronic circuit 9 for generating a voltage signal VinDC includes a voltage generator 9A that can preferably generate a constant voltage signal which is coupled, for example, to the input terminal 3A of the right arm 3 of the bridge-type switching amplifier.

In this configuration, the current detection device 7 is connected to the right arm 3 of the bridge-type switching amplifier 1. Particularly, this current detection device 7 is connected to the output terminal 3C of the right arm 3, i.e. in the virtual ground point.

In an advantageous configuration, the voltage generator 9A is preferably embodied by a grounding element, so that the input terminal 3A of the right arm 3 of the amplifier 1 is at a constant zero value.

Advantageously, the test voltage signal to be applied to the input terminals 2A, 3A of the bridge-type switching amplifier and hence to the terminals 4D, 4E of the load 4, is only present on one the input terminals, and hence on one of the outputs 2C, 3C.

In other words, the bridge-type switching amplifier 1 is controlled in a differential manner, i.e. voltage is applied to one input terminal, whereas the other terminal is grounded.

Particularly, the voltage VinAC is applied to the terminal 2A, whereas the input terminal 3A is grounded, which means that VinAC is present at the terminal 4D and the terminal 4E is grounded.

It shall be noted that the circuit configuration as shown in FIG. 5 (although this also applies to the configuration of FIG. 8) may be implemented by providing a dual arrangement of the first and second electronic circuits 8 and 9. In other words, the first electronic circuit 8 generates the voltage signal VinAC to be applied to the terminal 4E of the load 4 whereas the second electronic circuit 9 generates the constant voltage signal VinDC to be applied to the terminal 4D of the load 4, where the current detection device 7 is connected with the second electronic circuit 9.

Figure 3:
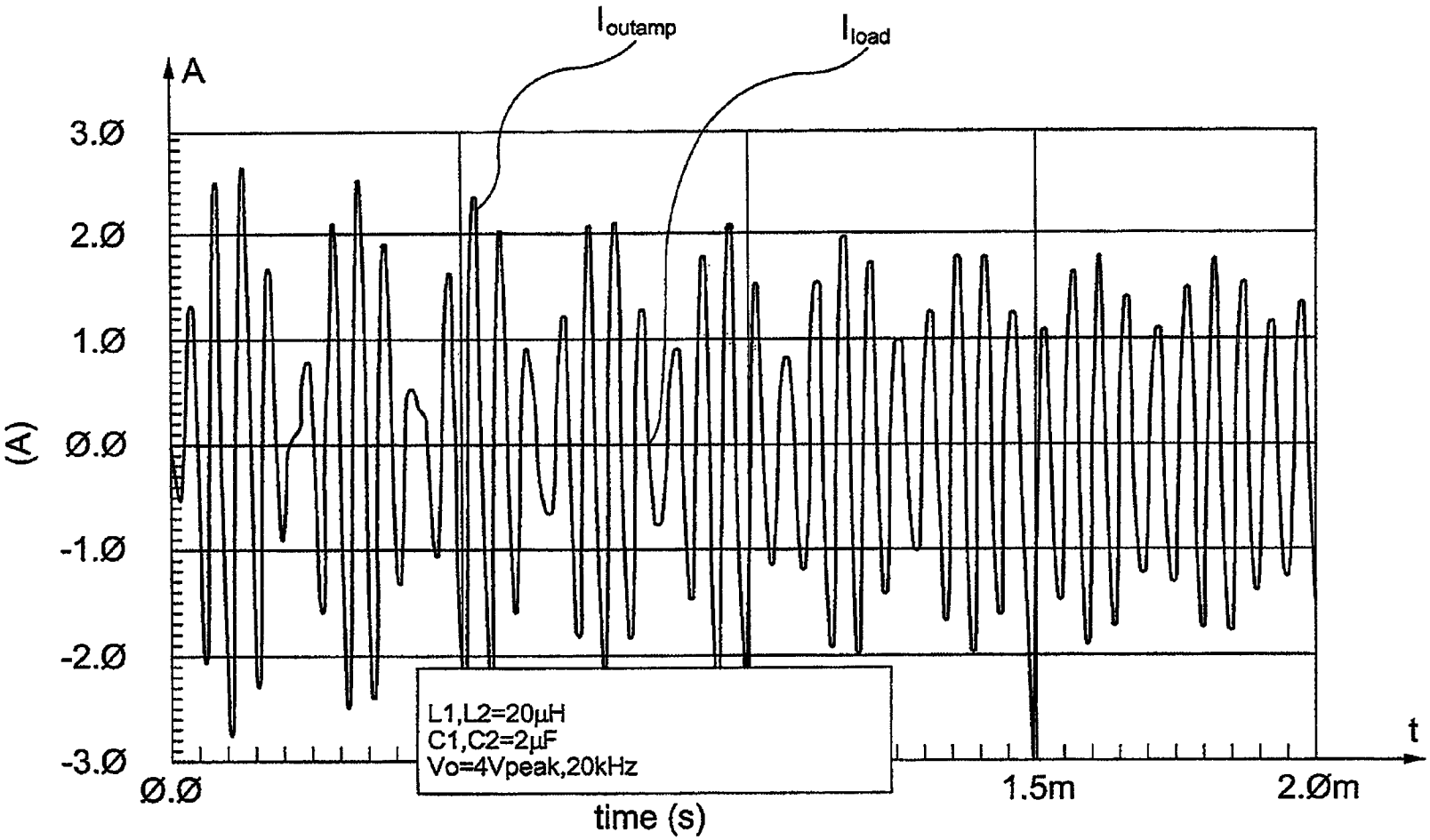
FIGS. 3 and 4 show the results of simulations of the circuit as shown in FIG. 1.
Figure 4:
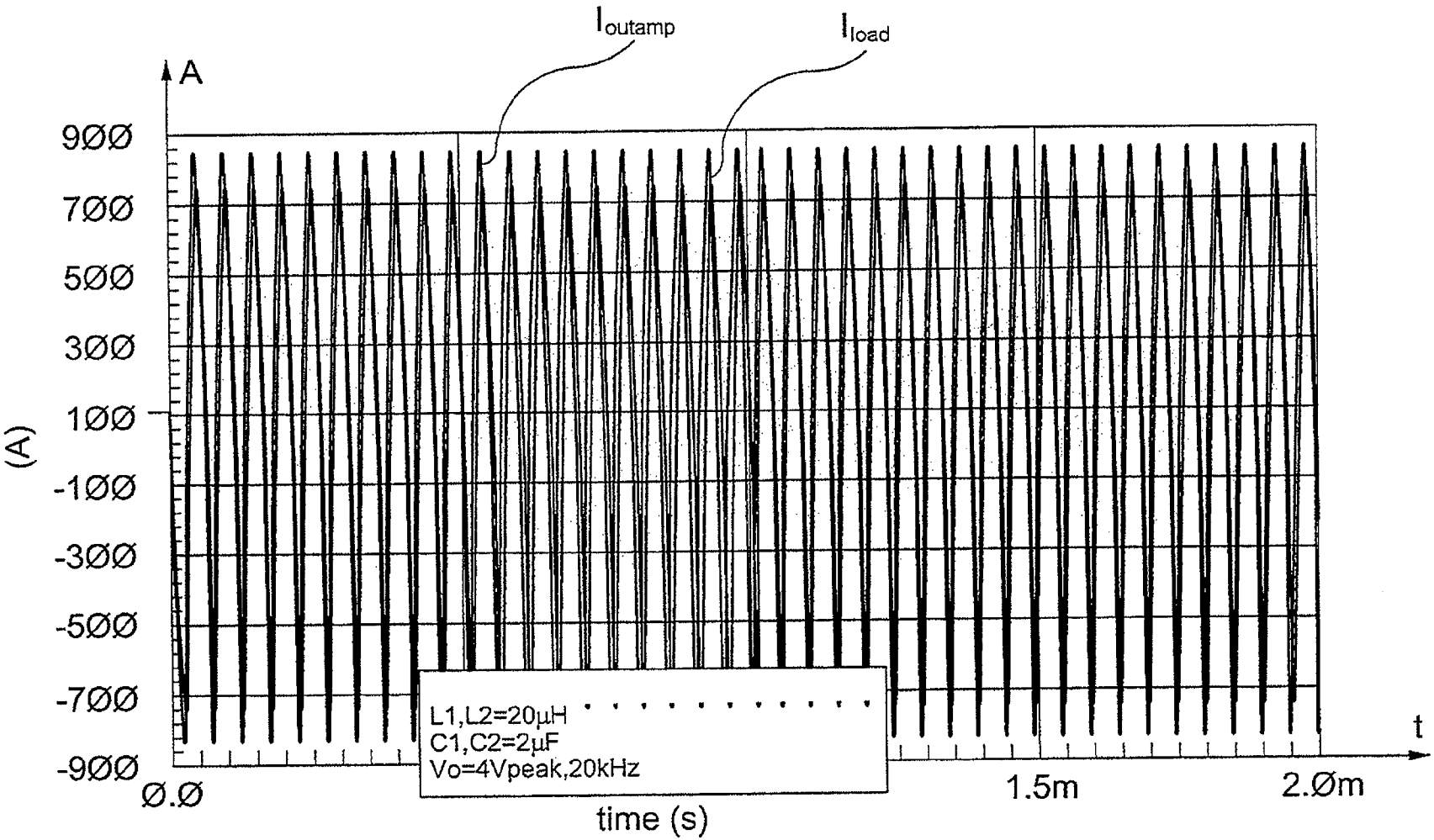
Figure 6:
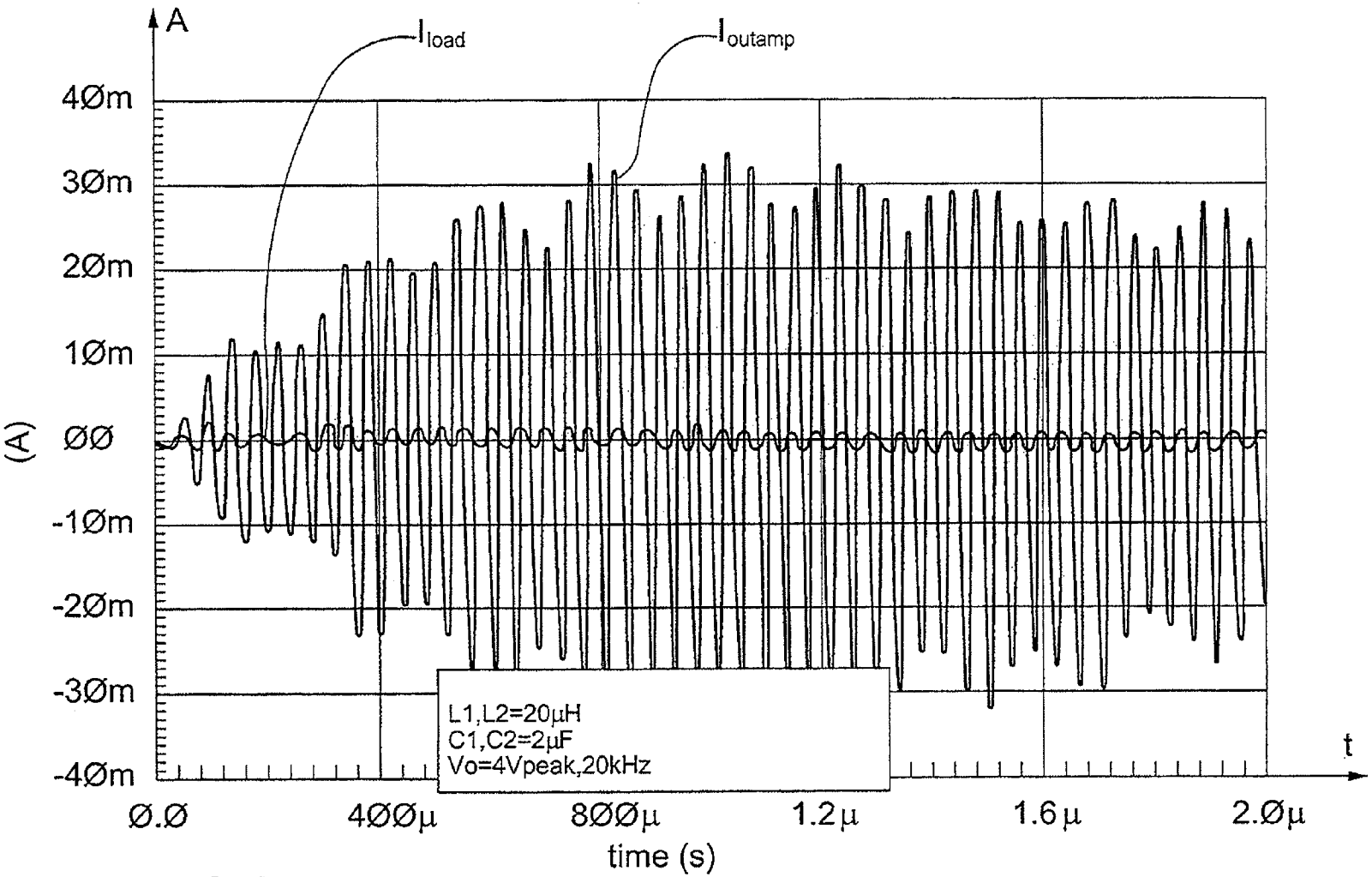
FIGS. 6 and 7 show the results of simulations of the circuit as shown in FIG. 5.
Figure 7:
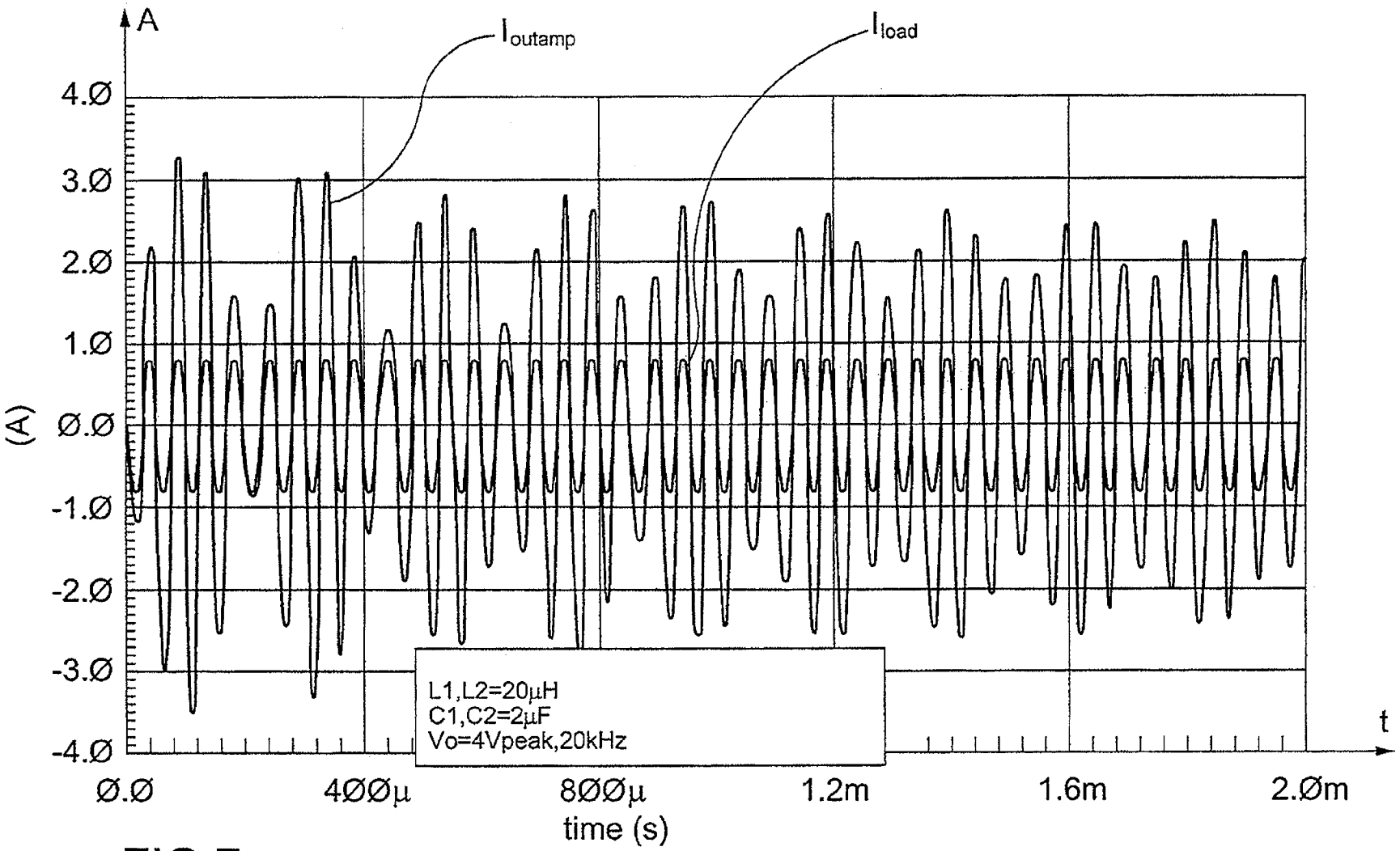

Referring now to the simulations of the circuit of FIG. 5, whose results are shown in FIGS. 6 and 7, and to allow comparison of such results with those of FIGS. 3 and 4, a voltage VinAC that corresponds to twice the voltage Vin (VinAC=2*Vin) is applied to the input terminal 2A, by the generator 8A, and grounding is applied to the input terminal 3A by the generator 9A, assuming that L1, L2 are 20 μH and that C1, C2 are 2 μF, so that such simulations show that the current $I_{load}$ that flows into the load 4 and the current $I_{outamp}$ that flows in the right arm 3 can assume the following values:

- if the load 4 is simulated by an impedance having a resistive value of 10 KΩ (see FIG. 6), corresponding to a situation in which such load 4 is an open circuit, the current $I_{outamp}$ is lower than 40 mA and in a range of peak values from −30 mA to +30 mA, whereas the current $I_{load}$ that flows into the load is nearly zero;
- if the load 4 is simulated by an impedance having a resistive value of 4Ω (see FIG. 4), corresponding to a situation in which such load 4 is a normal load (i.e. a normal loudspeaker combination), the current $I_{outamp}$ is in a range of peak current values from about −3A to +3A, whereas the current $I_{load}$ that flows into the load 4 is also in a range of peak current values from about −0.8A to +0.8A.

As shown by FIG. 6, the results of the simulations indicate that, with a 10 KΩ load 4, an acceptable, although not perfect result can be achieved, because $I_{outamp}$<40 mA, whereas in the case of FIG. 7, in which the load 4 is 4Ω, the determination can lead to an error, because the current $I_{outamp}$ is comparable to the value of the current that flows into the load $I_{load}$.

In other words, once the current reading device 7 has completed its measurement process, it is possible to determine with a certain degree of certainty whether the load 4 is actually disconnected because $I_{outamp}$<40 mA, but it is not possible to determine with the same degree of certainty whether the load 4 is connected, because the value of the current $I_{outamp}$ is comparable to the value of the current that flows into the load $I_{load}$.

In certain cases, this can be a problem.

This occurs because, considering the specific circuit configuration as shown in FIG. 5 and due to the frequencies of the test voltage VinAC, a certain amount of current may flow in the capacitor C2 of the low-pass filter 6 thereby leading to an error in the detection of current $I_{outamp}$.

Furthermore, such inaccuracy may be caused by a possible attenuation (overshoot) induced by the resonance frequency of the inductor L2 of the low-pass filter 6, which resonance frequency can cause the signal at the ends of the load 6 to be different from the signal that is set by the voltage generators 8A and 9A.

Figure 8:
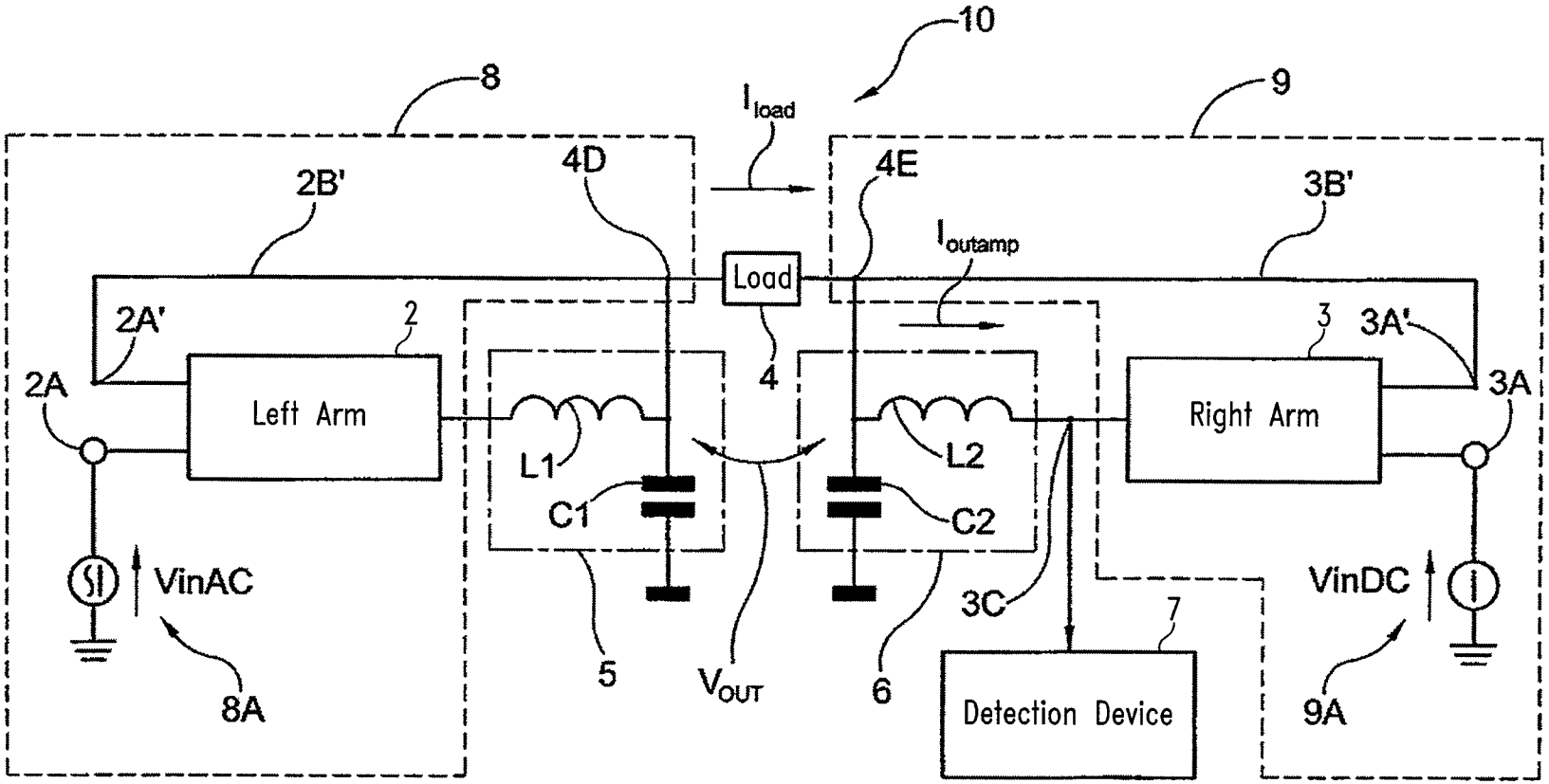
FIG. 8 shows a further possible circuit implementation of the present invention.

To obviate this problem, further referring to FIG. 8, in which the elements described above are designated by identical reference numerals, another circuit configuration 10 is provided for the bridge-type Class D switching amplifier, in which:

- the left arm 2 includes a feedback line 2B' which is directly coupled to the terminal 4D of the load 4,
- the right arm 3 includes a feedback line 3B' which is directly coupled to the terminal 4E of the load 4.

The advantage provided by the circuit configuration of FIG. 8 is self-evident.

The voltage VinAC applied to the input terminal 2A is transmitted nearly unchanged to the terminal 4D of the load 4, whereas the voltage VinDC applied to the input terminal 3A is transmitted nearly unchanged to the terminal 4E of the load 4.

If a zero volt voltage VinDC is selected as an appropriate value, i.e. the input value 3A is grounded, the terminal 4E is also grounded because, thanks to the feedback line 3B, the terminal 4E acts as a virtual ground node.

In other words, the load 4 has the high-frequency voltage signal (frequency above 20 KHz) at the terminal 4D and grounding at the other terminal 4E, i.e. a potential difference corresponding to the voltage VinAC applied to the input terminal 2A is provided in the load.

Figure 9:
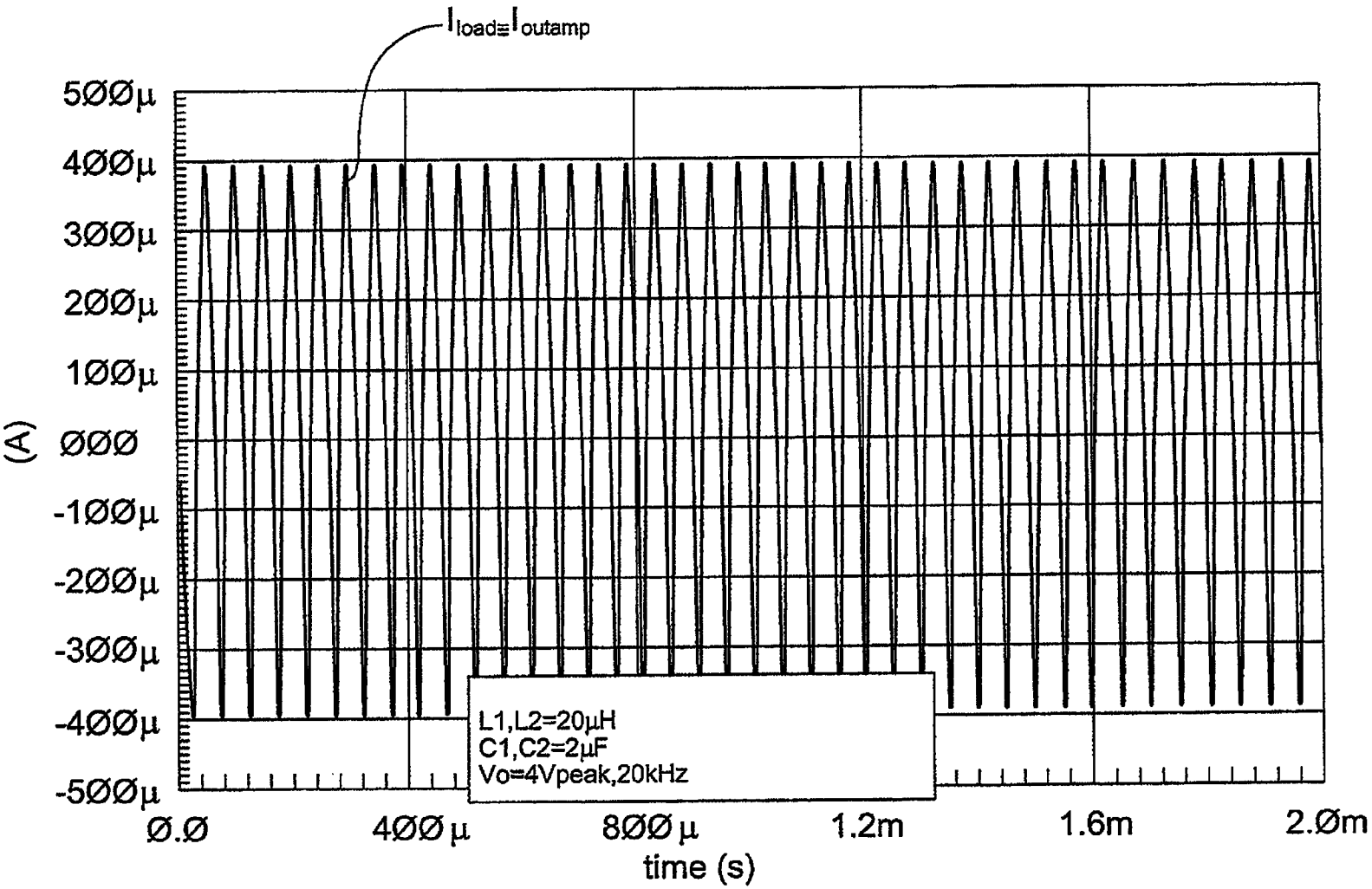
FIGS. 9 and 10 show the results of simulations of the circuit as shown in FIG. 8.
Figure 10:
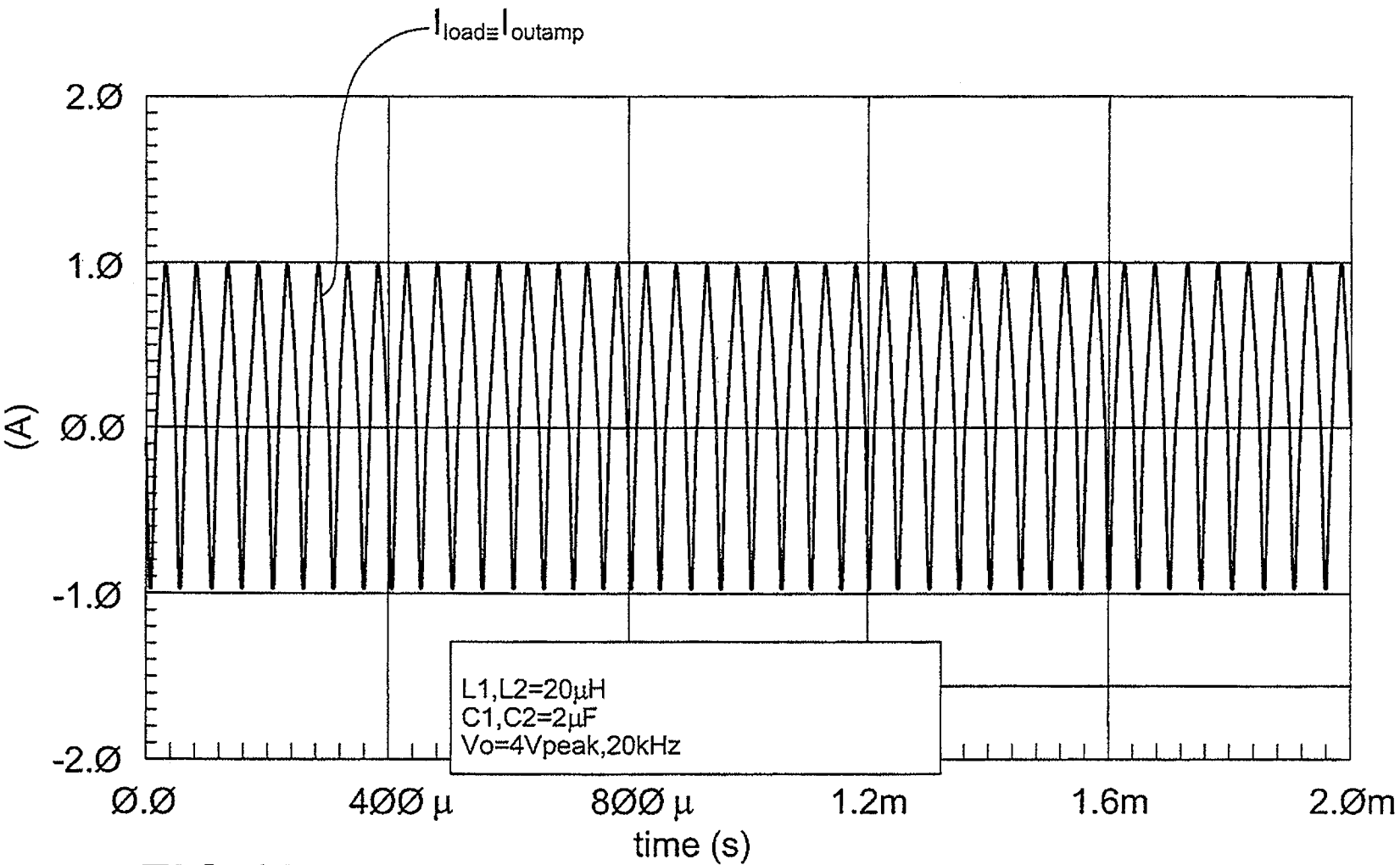

Referring now to the simulations of the circuit of FIG. 8, whose results are shown in FIGS. 9 and 10, and to allow comparison of such results with those of FIGS. 3 and 4, a voltage VinAC that corresponds to twice the voltage Vin is applied to the input terminal 2A, by the generator 8A, and grounding is applied to the input terminal 3A by the generator 9A, assuming that L1, L2 are 20 μH and that C1, C2 are 2 μF, so that such simulations show that the current $I_{load}$ that flows into the load 4 and the current $I_{outamp}$ that flows in the right arm 3 can assume the following values:

- if the load 4 is simulated by a 10 KΩresistance (see FIG. 9), corresponding to a situation in which such load 4 is an open circuit, the current $I_{outamp}$ and the current $I_{load}$ are in a range of peak values of ±400 μA;
- if the load 4 is simulated by a 4Ω resistance (see FIG. 10), corresponding to a situation in which such load 4 is a normal load (i.e. a normal loudspeaker combination), the current $I_{outamp}$ and the current $I_{load}$ that flows into the load 4 are in a range of peak values of ±1 A.

In other words, the currents $I_{outamp}$ and $I_{load}$ coincide in either case, i.e. either when the load 4 is simulated by an impedance having a 10 kΩresistance (see FIG. 9) or when the load 4 is simulated by an impedance having a 4Ω resistance (see FIG. 10), thereby eliminating any possible error.

Thus, the device 7 that reads the current flowing into the load 4 after measuring the amplitude of the current flowing into such load 4 determines whether the load is connected to the amplifier.

In other words, by applying a high-frequency voltage signal to the terminal 4D of said load 4 and a constant voltage signal to the other terminal 4E of said load 4, it is possible to measure the current $I_{load}$ that flows through said load 4 and determine a connect/disconnect state of said load 4 from the value of said current $I_{load}$.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method for testing a speaker, said method comprising:

applying a high-frequency voltage signal to a first terminal of said speaker, said high-frequency voltage signal being generated by a first electronic circuit;

applying a constant voltage signal to a second terminal of said speaker, said constant voltage signal being generated by a second electronic circuit;

measuring a current that flows through said speaker into said second electronic circuit; and determining a connect/disconnect state of said speaker from a value of said current; wherein the terminals of said speaker are coupled to a Class D switching amplifier of a bridge topology; said first electronic circuit includes a first arm of said Class D switching amplifier, said high-frequency voltage signal being applied to an input of the first arm; said second electronic circuit includes a second arm of said Class D switching amplifier, said constant voltage signal being applied to an input of the second arm; and said measuring said current that flows through said speaker includes measuring the current that flows in said second arm of said Class D switching amplifier.

2. A method as claimed in claim 1, wherein:

the first terminal of said speaker is coupled to said first arm of the Class D switching amplifier via a first low-pass filter and the second terminal of said speaker is coupled to said second arm of the Class D switching amplifier via a second low-pass filter, said first arm and said second arm of the Class D switching amplifier having a feedback arrangement upstream from said first and second low-pass filters, and said determining a connect/disconnect state of said speaker includes determining that:

said speaker is connected if said current that flows through said speaker has a non-zero, first value, and said speaker is disconnected if said current that flows through said speaker has a second value that is at least an order of magnitude less than the first value.

3. A method as claimed in claim 1, wherein:

the first terminal of said speaker is coupled to said first arm of the Class D switching amplifier via a first low-pass filter and the second terminal of said speaker is coupled to said second arm of the Class D switching amplifier via a second low-pass filter, said first arm and said second arm of the Class D switching amplifier have a feedback relationship with said terminals of said speaker respectively, said determining a connect/disconnect state of said speaker includes determining that said speaker is connected if said current that flows through said speaker coincides with said current that flows in said second arm.

4. A method as claimed in claim 1, wherein said high-frequency voltage signal has a frequency above 20 KHz.

5. A method as claimed in claim 1, wherein said constant voltage signal has a zero value.

6. The method as claimed in claim 1, wherein measuring the current that flows through said speaker into said second electronic circuit is done at a node located between the second terminal of said speaker and the second electronic circuit.

7. A test circuit for testing a speaker, said circuit comprising:

first and second test circuit terminals configured to be coupled to first and second terminals of said speaker, respectively;

a high-frequency voltage generating circuit structured to generate a high-frequency voltage signal on the first test circuit terminal;

a constant voltage generating circuit structured to generate a constant voltage signal on the second test circuit terminal; and a measuring device configured to measure current flowing in said speaker, said measuring device being coupled to a node between the constant voltage generating circuit and the second test circuit terminal; wherein said high-frequency voltage generating circuit includes a first arm of a Class D switching amplifier coupled to the first and second test circuit terminals, and a voltage generator coupled to a first terminal of the first arm and structured to provide said high-frequency voltage signal to said first terminal of the first arm; said constant voltage generating circuit includes a second arm of said switching amplifier, and a voltage generator coupled to a first terminal of the second arm and structured to provide said constant voltage signal to said first terminal of the second arm; and said measuring device is coupled to a second terminal of said second arm of said switching amplifier.

8. A test circuit as claimed in claim 7, further comprising:

a first low-pass filter coupled between a second terminal of the first arm and the first test circuit terminal, the first arm including a third terminal feedback connected to the second terminal of the first arm; and a second low-pass filter coupled between the second terminal of the second arm and the second test circuit terminal, the second arm including a third terminal feedback connected to the second terminal of the second arm.

9. A test circuit as claimed in claim 7, further comprising:

a first low-pass filter coupled between a second terminal of the first arm and the first test circuit terminal, the first arm including a third terminal feedback connected to the first test circuit terminal; and a second low-pass filter coupled between the second terminal of the second arm and the second test circuit terminal, the second arm including a third terminal feedback connected to the second test circuit terminal.

10. A test circuit as claimed in claim 7, wherein said high-frequency voltage generating circuit is structured to generate said high-frequency voltage signal at a frequency above 20 KHz.

11. A test circuit as claimed in claim 7, wherein said constant voltage generating circuit is structured to generate said constant voltage signal having a zero value.

12. A loudspeaker system, comprising:

a speaker having first and second terminals; and a test circuit for testing the speaker, said test circuit including:

first and second test circuit terminals coupled to the first and second terminals of said speaker, respectively;

a high-frequency voltage generating circuit structured to generate a high-frequency voltage signal on the first test circuit terminal;

a constant voltage generating circuit structured to generate a constant voltage signal on the second test circuit terminal; and a measuring device configured to measure current flowing in said speaker, said measuring device being coupled to a node between the constant voltage generating circuit and the second test circuit terminal; wherein said high-frequency voltage generating circuit includes a first arm of a Class D switching amplifier coupled to the first and second test circuit terminals, and a voltage generator coupled to a first terminal of the first arm and structured to provide said high-frequency voltage signal to said first terminal of the first arm; said constant voltage generating circuit includes a second arm of said switching amplifier, and a voltage generator coupled to a first terminal of the second arm and structured to provide said constant voltage signal to said first terminal of the second arm; and said measuring device is coupled to a second terminal of said second arm of said switchina amplifier.

13. A system as claimed in claim 12, wherein the test circuit includes:

a first low-pass filter coupled between a second terminal of the first arm and the first test circuit terminal, the first arm including a third terminal feedback connected to the second terminal of the first arm; and a second low-pass filter coupled between the second terminal of the second arm and the second test circuit terminal, the second arm including a third terminal feedback connected to the second terminal of the second arm.

14. A system as claimed in claim 12, wherein the test circuit includes:

a first low-pass filter coupled between a second terminal of the first arm and the first test circuit terminal, the first arm including a third terminal feedback connected to the first test circuit terminal; and a second low-pass filter coupled between the second terminal of the second arm and the second test circuit terminal, the second arm including a third terminal feedback connected to the second test circuit terminal.

15. A system as claimed in claim 12, wherein said high-frequency voltage generating circuit is structured to generate said high-frequency voltage signal at a frequency above 20 KHz.

16. A system as claimed in claim 12, wherein said constant voltage generating circuit is structured to generate said constant voltage signal having a zero value.

17. A method for testing a speaker, said method comprising: applying a high-frequency voltage signal to a first terminal of said speaker, said high-frequency voltage signal being generated by a first electronic circuit; applying a constant voltage signal to a second terminal of said speaker, said constant voltage signal being generated by a second electronic circuit; measuring a current that flows through said speaker into said second electronic circuit; and determining a connect/disconnect state of said speaker from a value of said current; wherein said first terminal of said speaker is coupled to said first electronic circuit via a first low-pass filter; and said second terminal of said speaker is coupled to said second electronic circuit via a second low-pass filter, said first electronic circuit and second electronic circuit each has a feedback relationship with the first and second terminals of said speaker respectively, said determining a connect/disconnect state of said speaker includes determining that said speaker is connected if said current that flows through said speaker coincides with said current that flows in the second electronics circuit.

18. A test circuit for testing a speaker, said circuit comprising: first and second test circuit terminals configured to be coupled to first and second terminals of said speaker, respectively; a high-frequency voltage generating circuit structured to generate a high-frequency voltage signal on the first test circuit terminal; a constant voltage generating circuit structured to generate a constant voltage signal on the second test circuit terminal; a measuring device configured to measure current flowing in said speaker, said measuring device being coupled to a node between the constant voltage generating circuit and the second test circuit terminal; and a first low-pass filter coupled between the first test circuit terminal and the first terminal of the speaker;

a second low-pass filter coupled between the second test circuit terminal and the second terminal of the speaker;

a first feedback terminal on the test circuit coupled to the first terminal of the speaker; and a second feedback terminal on the test circuit coupled to the second terminal of the speaker.

19. A loudspeaker system, comprising: a speaker having first and second terminals; and a test circuit for testing the speaker, said test circuit including: first and second test circuit terminals coupled to the first and second terminals of said speaker, respectively; a high-frequency voltage generating circuit structured to generate a high-frequency voltage signal on the first test circuit terminal; a constant voltage generating circuit structured to generate a constant voltage signal on the second test circuit terminal; a measuring device configured to measure current flowing in said speaker, said measuring device being coupled to a node between the constant voltage generating circuit and the second test circuit terminal; and wherein the test circuit further comprises:

a first low-pass filter coupled between the first test circuit terminal and the first terminal of the speaker;

a second low-pass filter coupled between the second test circuit terminal and the second terminal of the speaker;

a first feedback terminal on the test circuit coupled to the first terminal of the speaker; and a second feedback terminal on the test circuit coupled to the second terminal of the speaker.

* * * * *